US011933567B2

(12) United States Patent
Hodowanec et al.

(10) Patent No.: US 11,933,567 B2
(45) Date of Patent: Mar. 19, 2024

(54) MUZZLE BRAKED SUPPRESSOR

(71) Applicant: Hodowanec Design LLC, Murrysville, PA (US)

(72) Inventors: Mark Hodowanec, Murrysville, PA (US); Nicholas Hodowanec, Murrysville, PA (US)

(73) Assignee: HODOWANEC DESIGN LLC, Murrysville, PA (US)

( * ) Notice: Subject to any disclaimer, the term of this patent is extended or adjusted under 35 U.S.C. 154(b) by 163 days.

(21) Appl. No.: 17/714,712

(22) Filed: Apr. 6, 2022

(65) Prior Publication Data

US 2022/0404111 A1 Dec. 22, 2022

Related U.S. Application Data

(60) Provisional application No. 63/171,151, filed on Apr. 6, 2021.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36; F41A 21/38
See application file for complete search history.

(56) References Cited

U.S. PATENT DOCUMENTS

| | | | | |
|---|---|---|---|---|
| 8,844,422 | B1 * | 9/2014 | Klett | F41A 21/34 89/14.4 |
| 10,371,476 | B1 * | 8/2019 | Oglesby | F41A 21/30 |
| 10,393,463 | B1 * | 8/2019 | Sanders | F41A 21/34 |
| 10,684,088 | B2 * | 6/2020 | Lo | F41A 21/30 |
| 11,054,207 | B2 * | 7/2021 | Martin | F41A 21/28 |
| 11,268,777 | B1 * | 3/2022 | Grant | F41A 21/34 |
| 2017/0205175 | A1 * | 7/2017 | Garst | F41A 21/30 |
| 2019/0072352 | A1 * | 3/2019 | Garst | F41A 21/30 |

(Continued)

FOREIGN PATENT DOCUMENTS

| | | | | |
|---|---|---|---|---|
| CA | 2997705 | A1 * | 10/2018 | F41A 21/28 |
| EP | 3385658 | A1 * | 10/2018 | F41A 21/28 |

(Continued)

*Primary Examiner* — Jonathan C Weber
(74) *Attorney, Agent, or Firm* — Sandberg Phoenix & von Gontard P.C.

(57) ABSTRACT

A firearm suppressor with an integral muzzle brake that combines elements of muzzle brake, which comprises a plurality of radial/lateral ports that divert the high pressure propellant gas at an angle approximately perpendicular to the travel of the projectile thus reducing the recoil, with elements of a suppressor, which employs a plurality of axial baffles, each of which reduces the pressure, velocity and temperature of the propellant gas and before the gas is exhausted thus reducing the noise. Each individual axial stage has multiple subsequent radial/lateral chambers such that each axial stage has elements of a complete suppressor. Multiple expansion chambers each have an orifice connecting one expansion chamber to the next, and eventually vents to the external atmosphere. The exhaust port vents to the atmosphere and is directed radially or can be directed rearward to even further reduce the recoil in a similar fashion to a muzzle brake.

16 Claims, 11 Drawing Sheets

(56) References Cited

U.S. PATENT DOCUMENTS

| | | | | |
|---|---|---|---|---|
| 2019/0242667 | A1* | 8/2019 | Lo | F41A 21/30 |
| 2020/0025491 | A1* | 1/2020 | Petersen | B33Y 80/00 |
| 2020/0049442 | A1* | 2/2020 | Petersen | F41A 21/30 |
| 2020/0109907 | A1* | 4/2020 | Klett | F41A 21/30 |
| 2020/0141679 | A1* | 5/2020 | Garst | F41A 21/30 |
| 2020/0166304 | A1* | 5/2020 | Martin | F41A 21/28 |
| 2020/0292268 | A1* | 9/2020 | Lo | F41A 21/30 |
| 2021/0003360 | A1* | 1/2021 | Kras | F41A 21/30 |
| 2021/0041200 | A1* | 2/2021 | Kras | F41A 21/30 |
| 2021/0239419 | A1* | 8/2021 | Lo | F41A 21/30 |
| 2021/0278160 | A1* | 9/2021 | Petersen | F41A 21/30 |
| 2022/0049920 | A1* | 2/2022 | Kras | F41A 21/30 |
| 2022/0163281 | A1* | 5/2022 | Madigan | F41A 21/30 |
| 2022/0276016 | A1* | 9/2022 | Dueck | F41A 21/34 |

FOREIGN PATENT DOCUMENTS

| | | | | |
|---|---|---|---|---|
| RU | 2765508 | C2 * | 1/2022 | F41A 21/30 |
| WO | WO-2019134011 | A1 * | 7/2019 | F41A 21/30 |
| WO | WO-2021221819 | A2 * | 11/2021 | F41A 21/30 |

* cited by examiner

MUZZLE BRAKED SUPPRESSOR

CROSS-REFERENCE TO RELATED APPLICATIONS

This application claims the benefit of U.S. Provisional application 63/171,151, filed on Apr. 6, 2021. The disclosure of the above application is incorporated herein by reference in its entirety.

FIELD OF INVENTION

The invention relates generally to firearms, large guns and similar devices, and more particularly to muzzle brakes and suppressors (also referred to as silencers) for firearms for suppressing noise, muzzle blast and visible signature as well as reducing the apparent recoil of the weapon firing the projectile.

BACKGROUND OF THE INVENTION

Muzzle brakes are devices that attach to the muzzle of a firearm to reduce recoil and are a broadly known. Muzzle brakes attach to the end of a muzzle and redirect the propellant gas to counter the recoil forces. Known muzzle brakes generally contain an axial passage for the projectile to pass through along with a series of opening holes and/or slots approximately perpendicular to the projectile axis. When the projectile and propellant pass the opening holes/slots, some of the propellant gas impinges on the opening surfaces and produces a force in same direction as the projectile travel. This force is in the opposite direction of recoil and reduces the net recoil. There are negative characteristics associated with muzzle brakes, namely, muzzle brakes increase the noise and percussion of the firearm/cannon/artillery. Furthermore, muzzle brakes direct the blast back towards the shooter/spotter/gun crew. Muzzle brakes also can increase the dust signature. In spite of the negative attributes, muzzle brakes are commonly used as they significantly reduce recoil. A reduction of 35% to 50% is quite common with these devices. This makes shoulder fired weapons more manageable to shoot, and with the case of tank mounted cannons or artillery, reduces the size and weight of the recoil absorbing mechanism.

Generally, there are two elements to the recoil. The primary recoil is the equal and opposite reaction to the projectile as it exits the muzzle. The secondary recoil force is a result of the propellant gases (i.e., the burning gunpowder) exiting the muzzle. Although the mass of the propellant gas is generally less than that of the projectile, the velocity is significantly greater (typically twice the velocity of the projectile). Consequently, the secondary recoil component due to the propellant gas is large. At the same time, the high velocity/pressure propellant gas is what is used by the muzzle brake to reduce the net recoil. By changing the direction that these gases exhaust, the recoil component of the propellant gas can be eliminated. In addition, as the propellant gas is impinging on a forward surface of the muzzle brake port, a force in the same direction of projectile travel (which is opposite to the direction of the primary recoil) is generated reducing the net recoil. Angling the muzzle brake ports rearward increases this effect. With a muzzle brake, the projectile effectively acts like a piston, sealing the gas from exiting forward (in the same direction as a projectile) and redirecting it thru the multiple muzzle brake ports and slots. In addition to a thrust in the opposite direction of the recoil force, the muzzle brake ports can be positioned to provide a lateral force on the barrel in a desired direction. If the muzzle brake ports are symmetrically located (e.g., 180 degrees apart) around the circumference of the brake, the lateral gas forces cancel each other out and there is no net lateral (or side-to-side) force. If the ports are not symmetric, but skewed in one direction, there will be a resultant lateral force on the end of the barrel. For instance, if the muzzle brake ports are skewed in an upward direction, then there will be a net downward force pushing the muzzle of the barrel down. Oftentimes this is helpful to control muzzle rise of shoulder fired weapons such as sniper rifles where it is important to minimize barrel movement so that bullet hits can be effectively seen by the shooter and in fully automatic guns (i.e., machine guns) to control muzzle rise.

Muzzle brakes do have several disadvantages. Muzzle brakes increase the muzzle blast, noise and dust kick up. Furthermore, instead of the muzzle blast and noise being directed forward in direction of the projectile, the muzzle blast is directed back towards the shooter, spotter or gun crew. The muzzle blast from a powerful muzzle brake equipped rifle is so loud that even with hearing protection the shooter risks suffering some permanent hearing damage. The sound heard by someone that is directly alongside the shooter (such as a spotter which is commonly used in modern sniper teams), is significantly greater than that heard by the shooter, as the shooter is directly behind the rifle and not beside it. In the case of large guns (such as 10 mm and 15 mm artillery) the blast overpressure is so great that it has a similar effect as an explosion. The concussive effect that results from the firing of these large guns is cumulative and can be a component of traumatic brain injury. Although muzzle brakes reduce recoil, they do so at the expense of increasing the blast overpressure. In addition to muzzle brakes increasing the sound level to the shooter and spotter, another serious disadvantage of muzzle brakes is that the redirected high velocity gas typically causes dust and debris on the ground to get kicked up, creating dust clouds, referred to herein as a dust signature, or dust kickup. These clouds not only impair shooter visibility but disclose the location of the shooter. From a tactical perspective, this is disadvantageous.

Suppressors, or silencers, as they are often referred to, are devices that attach to the muzzle of a firearm and reduce the muzzle blast, flash, noise and visible signature generated when the weapon is fired. A suppressor has a much greater internal volume than the barrel. When the gun is fired and the projectile exits the barrel (but is still in the suppressor), the gas expands from the barrel into the suppressor. Suppressors typically have multiple axial baffles which create multiple chambers which increase the propellant gas turbulence and expansion. This turbulence and expansion cools the gas and in so doing, reduces the gas temperature and pressure. As the projectile travels down the bore of the suppressor, it seals the gas behind it. This allows the expansion and cooling to occur in each successive chamber. Eventually the projectile exits the suppressor bore and the expansion and cooling of the propellant gas has occurred multiple times and the propellant gas has expanded to fill the barrel and full suppressor volume. The increased expansion and turbulence also results in more complete combustion of the propellant gas. As the propellant gas exits the suppressor bore, it is significantly cooled and at a much lower pressure. As a result, the gas exiting the suppressor emits far less noise and flash than it would have if it directly left the barrel (i.e., if the rifle was unsuppressed). Although suppressors do reduce the recoil by a slight amount, this effect is not significant, and inferior as compared to a muzzle brake.

Large, high powered sniper rifles (such as those chambered in 300 Winchester Magnum, 338 Lapua Magnum, 50 BMG (12.7×99 NATO), etc.) greatly benefit from recoil reduction that only muzzle brakes can offer.

A muzzle brake equipped magnum rifle (like a .300 Winchester Magnum, 338 Lapua Magnum, 50 BMG) produce noise at a level 175 dB or greater. Because of their recoil, these rifles almost always have muzzle brakes. Muzzle brakes increase the noise by 20 dB or more (although the increase can be more or less and is dependent on the specific muzzle brake design). Without the muzzle brake, these rifles would produce approximately 155 dB of noise. Earmuff type hearing protectors for shooters firing shoulder fired weapons typically reduce noise by approximately 25 dB. Firing a muzzle braked rifle, even with ear muffs the sound inside the hearing protector can be in excess of 150 dB, a potentially damaging level. It is often recommended that ear plugs be used in conjunction with earmuffs (i.e., use double hearing protection) when shooting large/magnum rifles with muzzle brakes. This makes it impossible for the shooter to hear anything in his environment which is a hazard for both a hunter and a soldier. For a hunter or soldier shooting without ear protection, the muzzle blast from a muzzle brake is immediately deafening. Although temporary deafness usually lasts for a short period of time, a certain amount of hearing is permanently lost, and the losses are cumulative. Suppressors can reduce the sound by as much as 30 dB (depending on suppressor design) while muzzle brakes increase 20 dB or more. So, if these rifles were shot with a suppressor instead of a muzzle brake, the noise would be potentially reduced from 175 dB to 125 dB. Nonetheless, the recoil reduction that muzzle brakes provide makes them the muzzle device of choice in certain applications.

BRIEF SUMMARY OF THE INVENTION

The present invention relates to a firearm suppressor with an integral muzzle brake. This integrated muzzle braked suppressor (MBS) of the present disclosure generally comprises a plurality of radial/lateral ports that diverts the high pressure propellant gas at an angle approximately perpendicular to the travel of the projectile (i.e., orthogonal to an center axis A of MBS) thus reducing the recoil, and a plurality of axial baffles, each of which reduces the pressure, velocity and temperature of the propellant gas before any remaining gas is ultimately exhausted down the suppressor bore thus reducing the noise and recoil. Unlike a traditional suppressor, each individual axial stage has multiple subsequent radial/lateral chambers connected with an orifice or port so the propellant gas can flow from one expansion chamber to the next. Thus, each axial stage has elements of a complete suppressor (i.e., each axial stage is like a 'mini suppressor'): there are multiple expansion chambers, each or which has an opening or orifice connecting one expansion chamber to the next, each subsequent expansion chamber increases the chamber volume while reducing temperature and pressure, with the last expansion chamber exhausting the propellant gas to the external atmosphere. The size of the opening or orifice between the expansion chambers of each axial stage are not constrained by the projectile diameter as they are in a traditional suppressor. Each opening or orifice can be optimally sized for best control of the gas pressure, velocity and temperature. The exhaust port (the final port for each axial stage of the MBS) vents to the atmosphere and is directed radially or can be directed rearward to even further reduce the recoil in a similar fashion to a muzzle brake. In addition, the volume, velocity, temperature and pressure within each expansion chamber is optimized such that when the gas gets to the exhaust port, the noise is minimized, recoil reduction is maximized, and gas velocity is at a rate that results in a minimal dust signature. While traditional muzzle brakes are very effective at reducing recoil, they significantly increase the dust signature, percussion and noise (typically 20 dB to 30 dB louder than guns without muzzle brakes). For the MBS, the arrangement of multiple axial stages, each of which is a 'mini suppressor' with an integral exhaust brake, results in a plurality of mini suppressors & muzzle brakes which have the overall effect of reducing the noise more effectively than a traditional suppressor while eliminating the dust signature and reducing the recoil more effectively than a muzzle brake.

In various exemplary embodiments, the present disclosure provides an integrated muzzle braked suppressor. The principal objective of the present invention is to provide a muzzle braked suppressor (MBS) that significantly reduces noise and muzzle blast while at the same time decreases the recoil of the weapon firing the projectile. A secondary objective is to provide an MBS that reduces the noise more effectively than current suppressors. A tertiary objective is to provide an MBS that reduces the recoil as much if not more than current state of the art muzzle brakes. The final objective is to provide an MBS that reduces the pressure wave and directs the muzzle blast in such a way that the visible signature is eliminated or greatly reduced.

In various embodiments, the integrated MBS of the present disclosure comprises the following key elements:

- Multiple axial stages separated by baffles with a hole in the baffle to let the projectile pass through. The entry pressure of the propellant gas of each subsequent axial stage will be less than the entry pressure for the preceding axial stage.
- Each axial stage has multiple lateral/radial expansion chambers. Each lateral/radial expansion chamber is connected to the previous chamber with an opening or orifice which controls the expansion rate of the propellant gas from one chamber to the next and in so doing controls the pressure, temperature and velocity of the gas. The final orifice is the exhaust port, which vents the propellant gas to the external environment. The exhaust port can be directed at a non-orthogonal angle, e.g., a rearward angle, and in so doing will provide an even greater forward thrust to further reduce the recoil. In some embodiments, not all of the subsequent radial/lateral chambers are on the MBS that is attached to the barrel. In these embodiments the exhaust port is 'piped' to an external 'silencer' that has additional chambers and ultimately an exhaust port.

In various exemplary embodiments, the present disclosure comprises multiple axial stages with each axial stage radially vented to a series of subsequent chambers, before being exhausted to the atmosphere. In one embodiment, the initial outer chamber has radial partitions which form multiple additional expansion chambers. The first radial partition has an orifice enabling the first expansion chamber to vent to the second expansion chamber. Likewise, the second expansion chamber has a wall with an orifice which enables the second expansion chamber to vent to the third expansion chamber. This continues on until the last chamber is reached which has an orifice on the outer suppressor/muzzle brake tube. This radial outer orifice lets the propellant gas exhaust in a radial direction to an exhaust director. The exhaust director controls the direction that the propellant gas is exhausted to the atmosphere. This is typically in a rearward direction to further reduce recoil and/or upward direction to reduce recoil and muzzle rise or jump. The volume of all the expansion chambers and orifice size between the chambers are structured, sized and shaped such that by the time that the exhaust port is reached the gas has been sufficiently cooled, and the pressure/velocity reduced such that the gas can be exhausted with a minimal noise signature and no visible dust signature. It should be noted that the orifice size is not constrained to be larger than the projectile bore as it is in traditional suppressors. Each axial stage is in effect is a 'mini suppressor'. All the subsequent axial stages are similarly constructed with multiple expansion chambers ultimately exhausting the propellant gas to the atmosphere. With each subsequent axial stage, the gas pressure, velocity and temperature is less than at the previous axial stage and the subsequent radial/lateral expansion chamber volumes and orifice sizes are structured, sized and shaped for a desired or predetermined volume, temperature and velocity of the propellant gas as it enters that particular axial stage. Subsequent axial stages are structured, sized and shaped based on the pressure that that particular axial stage receives, and each axial stage has its own 'mini suppressor' structured, sized and shaped for the desired or preselected gas conditions at that particular stage.

In other various exemplary embodiments, each axial stage is laterally vented to subsequent lateral chambers, created by stacking lateral plates with controlled orifices or openings. These openings act as openings or orifices and control the rate of gas expansion from one chamber to the next. The chamber volume is controlled by how the lateral plates are machined. In addition, within these expansion chambers formed by the lateral plates, features can be machined which promote turbulence, resulting in reduced temperature and pressure of the propellant gas. The last lateral plate is machined as an exhaust director, and it allows the gas to vent to the external atmosphere. In addition to being sized for optimal gas velocity and pressure control, the last lateral plate is machined to direct the gas in a rearward direction to enhance the muzzle brake aspects of the MBS. The volume of all the expansion chambers and opening or orifice size between the expansion chambers are structured, sized and shaped such that by the time that the exhaust port is reached the gas has been sufficiently cooled, and the pressure/velocity reduced such that the gas can be exhausted with a minimal noise signature and no visible dust signature. Thus each axial stage is in effect is a 'mini suppressor'. All the subsequent axial stages are similarly constructed with multiple expansion chambers ultimately exhausting the propellant gas to the atmosphere. In each subsequent axial stage, the gas pressure, velocity and temperature is less than at the previous stage and the subsequent lateral chamber volumes and orifice sizes are structured, sized and shaped for the volume, temperature and velocity of the propellant gas as it enters that particular axial stage. Subsequent axial stages are structured, sized and shaped based on the gas pressure that that particular axial stage receives, and each axial stage has its own 'mini suppressor' optimized for the gas conditions at that particular stage.

In still other various exemplary embodiments, there are multiple axial stages within the MBS that is attached to the barrel and the exhaust port of the MBS is plumbed/piped connected to an external suppressor or an unvented large volume accumulator. External within this context means the external tank/accumulator/suppressor may or may not be directly mounted on the barrel or gun. For example, instead of having the exhaust port venting the gas to the atmosphere, a pipe is affixed to the MBS exhaust port to allow the gas to flow to an external pipe and then to the external suppressor or tank/accumulator. The number of subsequent expansion chambers (expansion chambers subsequent to each primary axial stage chamber) on the MBS that is mounted on the gun barrel can be reduced to the point of having the primary axial stage chamber as the one that is being vented if the suppressor body and external pipe is strong enough (as the pressure will higher in the initial chambers). Each axial stage can be individually (i.e., independently) structured, sized and shaped for a desired balance of noise and recoil reduction. In addition, it is possible to have the exhaust port connected at different subsequent stages. For instance, the first axial stage could have a large external suppressor/tank/accumulator (large relative to the suppressor volume) and the exhaust port of this stages right after the primary chamber. The second axial stage could have a large volume external suppressor/tank/accumulator that is connected after the third expansion chamber, and the remaining axial stages similar to the 'mini suppressors' as described in previous embodiments. Any combination is feasible.

There are several advantages that the MBS of the present disclosure has over traditional suppressors. A first is that each radial/lateral expansion chamber has an orifice or opening which is sized (and not constrained by the projectile diameter) to maximize the slowing and cooling of the propellant gas based on the gas temperature, velocity and pressure. In addition, each one of these orifices can be independently sized (i.e., each orifice a different size) as necessary based on noise and recoil reduction optimization driven design considerations. The orifice size can be designed to optimize the rate of expansion of propellant gas from one expansion chamber to the next. Each orifice can be independently structured, sized and shaped such that when the propellant gas expands from one expansion chamber to the next the pressure and temperature will be different than in the previous expansion chamber. What is optimal depends upon the desired balance of noise suppression vs. recoil reduction to be obtained. For instance, a MBS for a .50 caliber sniper rifle will be designed to skew the balance towards recoil reduction whereas a .300 Blackout carbine shooting a subsonic bullet will skew the balance towards noise reduction.

Another advantage is that the MBS of the present disclosure includes multiple lateral/radial expansions chambers for each axial stage while maintaining a similar number of axial stages. The total number of expansion chambers is the product of number of expansion chamber and the number of axial stages. For instance, if an exemplary MBS has six axial chambers, with five radial/lateral expansion chambers each, there are a total of thirty expansion chambers as compared to six that a traditional suppressor would have. Furthermore, as the pressure is decreased as the projectile moves down the suppressor bore, and each radial chamber orifice can be structured, sized and shaped for a desired or predetermined particular pressure level.

There are also advantages as compared to traditional muzzle brakes. Namely, the entire gas impulse is not immediately exhausted out of the muzzle at muzzle pressure and velocity. Typical muzzle pressures for shoulder fired weapons are in the range of 10,000 to 15,000 psi (depending on caliber, barrel length, specific propellant and other variables). The propellant velocity is commonly taken to be twice that of the projectile velocity. The propellant gas is thus often times exiting the muzzle in excess of 8,000 feet per second, and at a pressure in excess of 15,000 psi but rapidly expanding to an atmospheric pressure of 14.7 psi (gas volume expands almost one thousand times). This violent expansion and rapid velocity is the force that is harnessed to effectively reduce recoil with a muzzle brake. Unfortunately, the percussion, noise and dust that is kicked up is greatly increased for the same reason. With the MBS of the present disclosure, the gas is released, but only after its velocity and pressure has been greatly reduced. In addition, the propellant gas is exhausted along the entire length of MBS (at each exhaust port at each axial stage) and not just at the muzzle. Thus, it is released over the length of time that pressure remains in the MBS. This results in the propellant gas being released at a lower pressure at any particular stage with a much longer gas impulse duration.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention. Furthermore, the features, functions, and advantages of the present invention can be achieved independently in various embodiments of the present inventions or may be combined in yet other embodiments.

BRIEF DESCRIPTION OF THE DRAWINGS

The present invention will become more fully understood from the detailed description and accompanying drawings, wherein.

Corresponding reference numerals indicate corresponding parts throughout the several views of drawings.

DETAILED DESCRIPTION OF THE INVENTION

Figure 1:
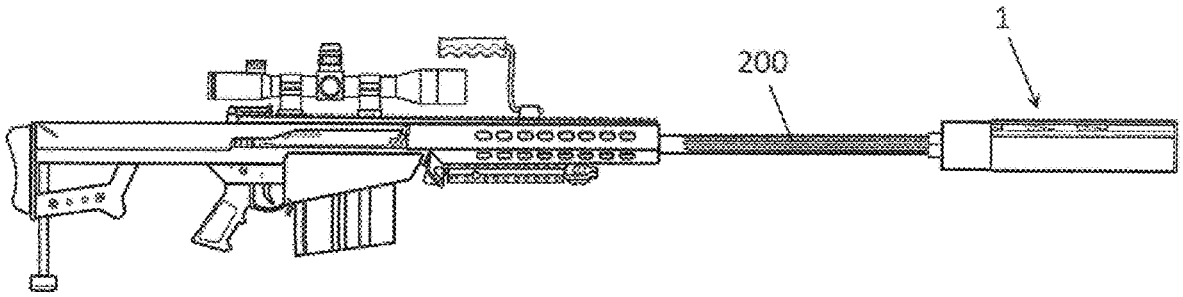
FIG. 1 exemplarily illustrates a radial MBS mounted on the barrel of a .50 caliber sniper rifle.
Figure 2:
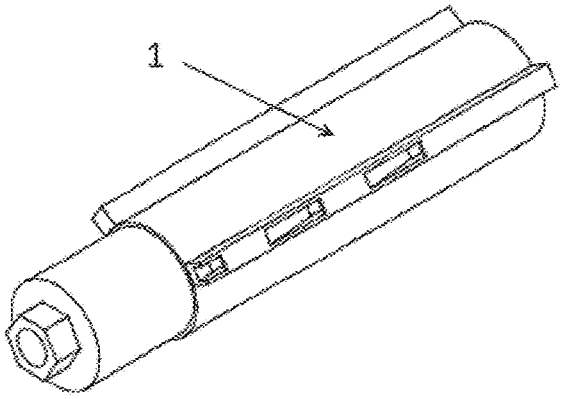
FIG. 2 exemplarily illustrates an isometric top view of the radial MBS, in accordance with various embodiments of the present disclosure.
Figure 3:
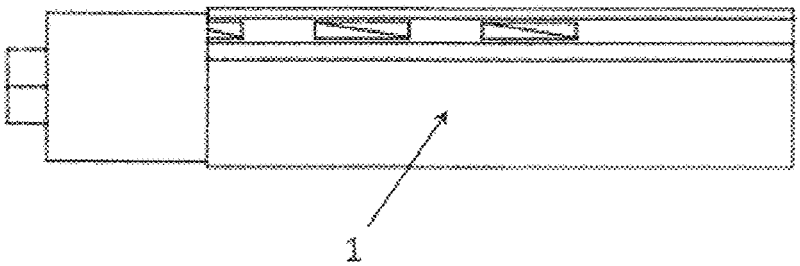
FIG. 3 exemplarily illustrates a side view of the radial MBS, in accordance with various embodiments of the present disclosure.

The following description is merely exemplary in nature and is in no way intended to limit the present teachings, application, or uses. Throughout this specification, like reference numerals will be used to refer to like elements. Additionally, the embodiments disclosed below are not intended to be exhaustive or to limit the invention to the precise forms disclosed in the following detailed description. Rather, the embodiments are chosen and described so that others skilled in the art can utilize their teachings. As well, it should be understood that the drawings are intended to illustrate and plainly disclose presently envisioned embodiments to one of skill in the art but are not intended to be manufacturing level drawings or renditions of final products and may include simplified conceptual views to facilitate understanding or explanation. As well, the relative size and arrangement of the components may differ from that shown and still operate within the spirit of the invention.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Unless otherwise defined, all technical and scientific terms used herein have the same meaning as commonly understood by one of ordinary skill in the art to which this disclosure belongs. The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises", "comprising", "including", and "having" are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps can be employed.

When an element, object, device, apparatus, component, region or section, etc., is referred to as being "on", "engaged to or with", "connected to or with", or "coupled to or with" another element, object, device, apparatus, component, region or section, etc., it can be directly on, engaged, connected or coupled to or with the other element, object, device, apparatus, component, region or section, etc., or intervening elements, objects, devices, apparatuses, components, regions or sections, etc., can be present. In contrast, when an element, object, device, apparatus, component, region or section, etc., is referred to as being "directly on", "directly engaged to", "directly connected to", or "directly coupled to" another element, object, device, apparatus, component, region or section, etc., there may be no intervening elements, objects, devices, apparatuses, components, regions or sections, etc., present. Other words used to describe the relationship between elements, objects, devices, apparatuses, components, regions or sections, etc., should be interpreted in a like fashion (e.g., "between" versus "directly between", "adjacent" versus "directly adjacent", etc.).

As used herein the phrase "operably connected to" will be understood to mean two are more elements, objects, devices, apparatuses, components, etc., that are directly or indirectly connected to each other in an operational and/or cooperative manner such that operation or function of at least one of the elements, objects, devices, apparatuses, components, etc., imparts are causes operation or function of at least one other of the elements, objects, devices, apparatuses, components, etc. Such imparting or causing of operation or function can be unilateral or bilateral.

As used herein, the term "and/or" includes any and all combinations of one or more of the associated listed items. For example, A and/or B includes A alone, or B alone, or both A and B.

Although the terms first, second, third, etc. can be used herein to describe various elements, objects, devices, apparatuses, components, regions or sections, etc., these elements, objects, devices, apparatuses, components, regions or sections, etc., should not be limited by these terms. These terms may be used only to distinguish one element, object, device, apparatus, component, region or section, etc., from another element, object, device, apparatus, component, region or section, etc., and do not necessarily imply a sequence or order unless clearly indicated by the context.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) taught herein, and because many modifications may be made in the embodiments described herein, it is to be understood that the details herein are to be interpreted as illustrative and non-limiting.

Figure 4:
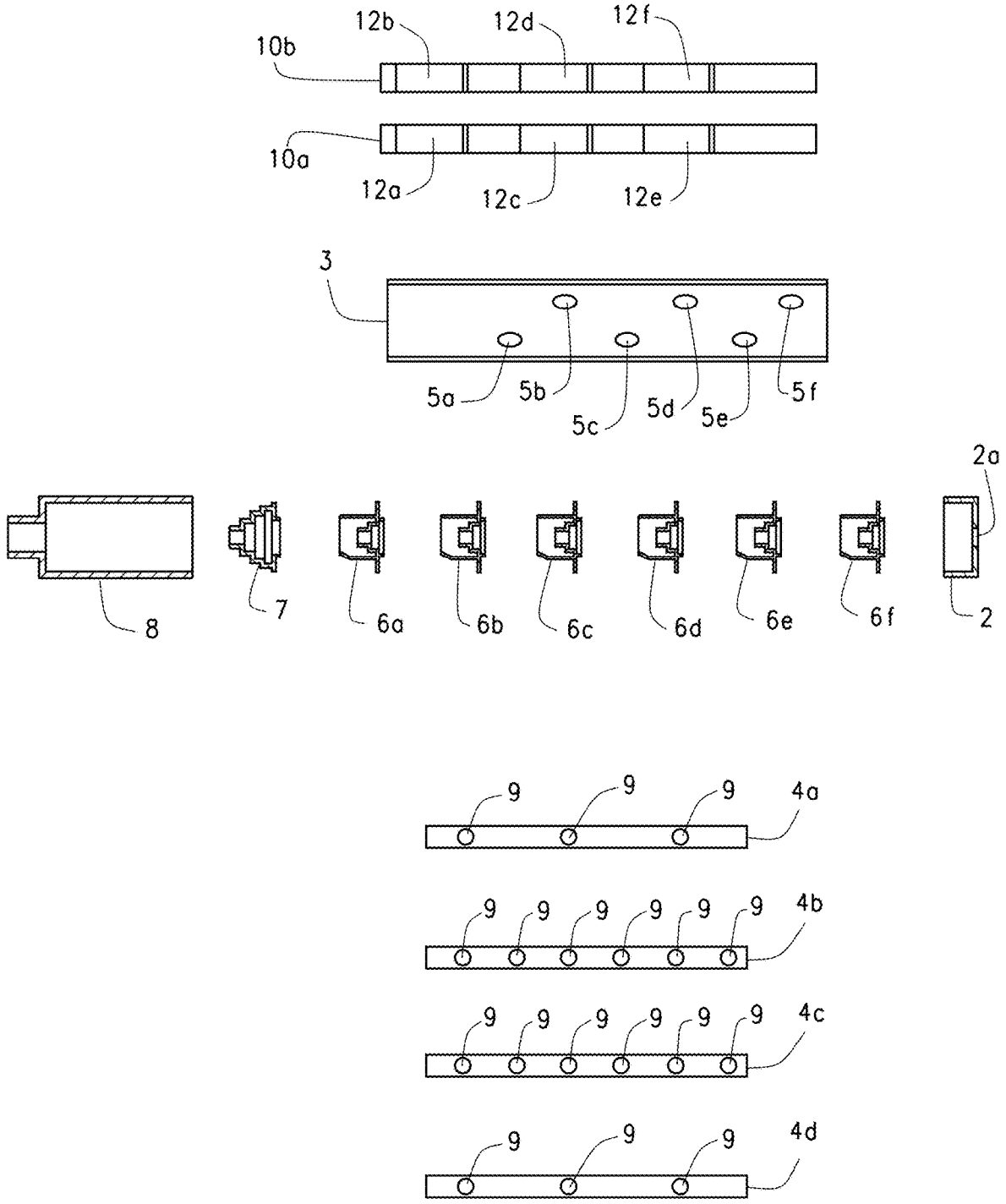
FIG. 4 exemplarily illustrates a side exploded assembly view of the radial MBS, in accordance with various embodiments of the present disclosure.
Figure 5:
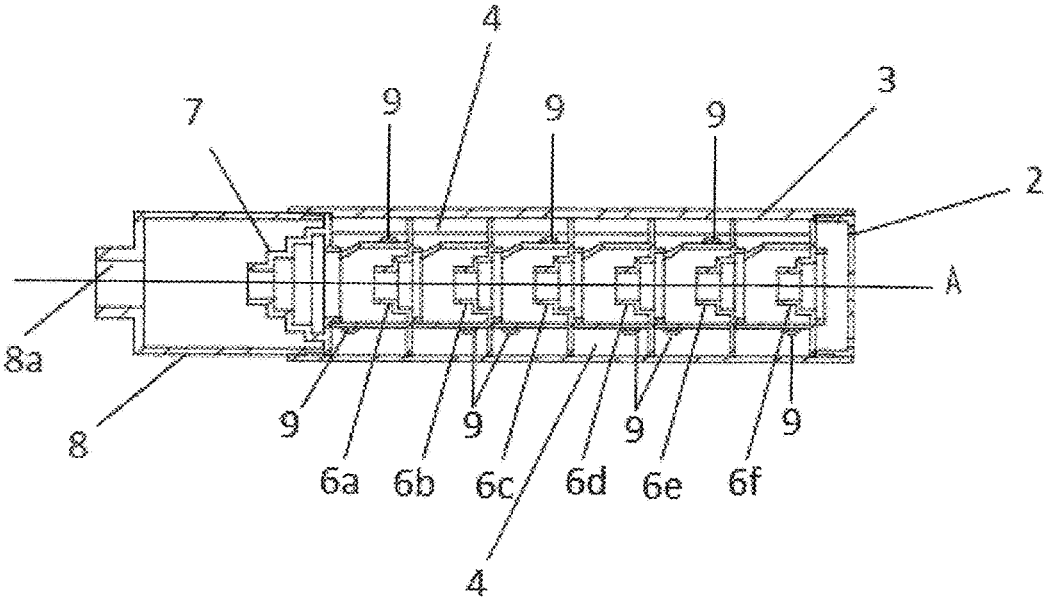
FIG. 5 exemplarily illustrates a side section view the of the radial MBS to provide component identification in accordance with various embodiments of the present disclosure.
Figure 6:
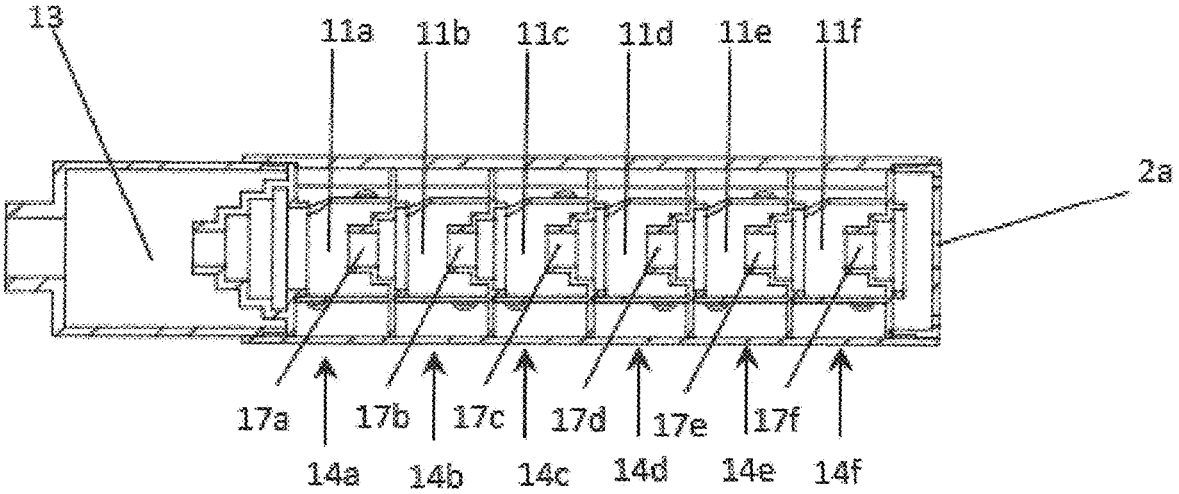
FIG. 6 exemplarily illustrates a side section view to provide axial stage and primary chamber identification of the Radial MBS, in accordance with various embodiments of the present disclosure.
Figure 7:
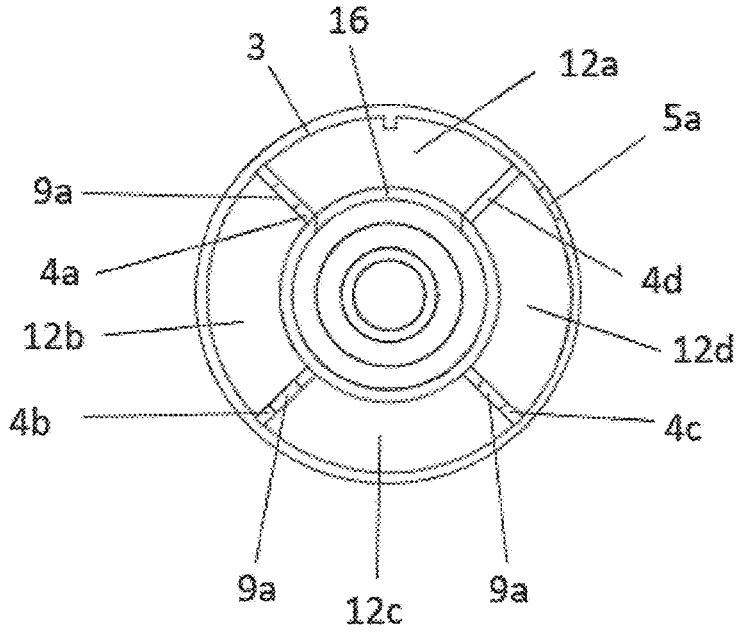
FIG. 7 exemplarily illustrates a perpendicular axial section view of the first axial stage to provide expansion stage identification of the Radial MBS, in accordance with various embodiments of the present disclosure.

Referring now to the various FIGS. 1 through 11, in accordance with various embodiments, the present disclosure provides a radial muzzle braked suppressor (MBS) 1 that is structured and operable to reduce recoil while at the same time reducing the muzzle blast and noise signature. In various instances, the MBS 1 can be configured in a radial configuration. The radial MBS is exemplarily illustrated in FIG. 2 and FIG. 3 and in an exemplary exploded view of the internal components in FIG. 4. FIG. 1 illustrates a radial MBS mounted on a .50 caliber sniper rifle. FIG. 5 exemplarily illustrates a cross sectional view of the assembled radial MBS 1. As exemplarily illustrated in FIGS. 6 and 7, in various embodiments the radial MBS 1 comprises a plurality of fluidly connected axial stages 14*a*, 14*b*, 14*c*, 14*d*, 14*e*, 14*f*, a plurality of fluidly connected primary expansion chambers 11*a*, 11*b*, 11*c*, 11*d*, 11 *e*, 11*f*, and each axial stage comprises a plurality of fluidly connected secondary expansion chamber 12. The axial stages 14 are disposed within the outer housing 3 and axially connected head-to-toe with each other along, and coaxially centered on, a center axis A of the MBS 1. A cross sectional view of the first axial stage 14*a* is exemplarily illustrated in FIG. 7 showing that in various embodiments the secondary expansion chambers 12 are acuately fluidly connected via the orifice/ports 9 (i.e., fluidly connected in a circular flow manner about the axis A), where a primary chamber 11*a* and secondary expansion chambers 12*a* (first secondary expansion chamber), 12*b* (second secondary expansion chamber), 12*c* (third secondary expansion chamber) and 12*d* (fourth secondary expansion chamber) are identified. The propellant gas flows from the first axial stage 14*a* primary chamber 11*a* to the first secondary expansion chambers 12*a* into the second secondary expansion chamber 12*b*, onto the third secondary expansion chamber 12*c*, onto the fourth secondary expansion chamber 12*d* before being exhausted through one of a plurality of the exhaust diverter housings 10 (e.g., through one of a plurality of the exhaust diverter housings 10*a*).

Figure 8:
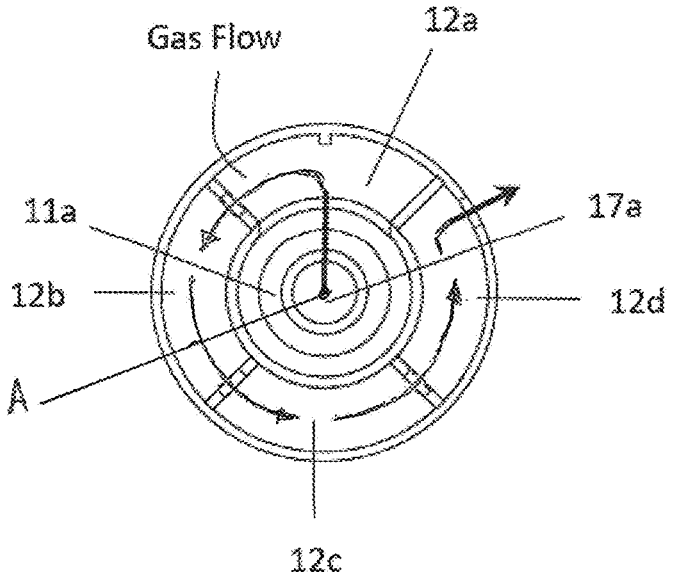
FIG. 8 exemplarily illustrates a perpendicular axial section view of the first axial stage to illustrate the propellant gas flow through the expansion stages identified in FIG. 7 for the Radial MBS, in accordance with various embodiments of the present disclosure.

In the first axial stage the expanding propellant gas flows from the primary chamber 11*a* to the first secondary expansion chamber 12*a* through the expansion port 16 as illustrated in FIG. 8. The propellant gas flows from the first secondary expansion chamber 12*a* through the orifice or port 9*a* (which is contained in the diverter bar 4*a*) to the second secondary expansion chamber 12*b*. In a similar fashion the propellant gas continues to flow from the second secondary expansion chamber 12*b* through a orifice/port 9*a* in a second divider bar 4*b* and enters the third secondary expansion chamber 12*c*. Once again, the propellant gas flows from the third secondary expansion chamber 12*c* through orifice/port 9*a* in a third divider bar 4*c* and enters the fourth secondary expansion chamber 12*d*. The propellant gas the flows from the fourth secondary expansion chamber 12*d* through the exhaust orifice 5*a* which is in the outer tube or housing 3 of the MBS 1. The diverter bar for the fourth secondary expansion chamber does not have an orifice thus the propellant gas can only exhaust through the exhaust orifice 5*a*. The direction of the expanding propellant gas is changed from a radial direction to a rearward direction by the exhaust housing port 18*a* contained in the exhaust diverter housing 10*a*. The exhaust diverter housing 10*a* is one of a plurality of exhaust diverter housings 10, exemplarily shown in FIG. 10. The angled exhaust ports 18*a* redirect the propellant gas from a radial direction (i.e., orthogonal to the center axis A) to a non-orthogonal angle, e.g., a rearward direction towards the shooter. This enables the propellant gas to more effectively reduce the recoil in a manner similar to a muzzle brake.

Figure 9:
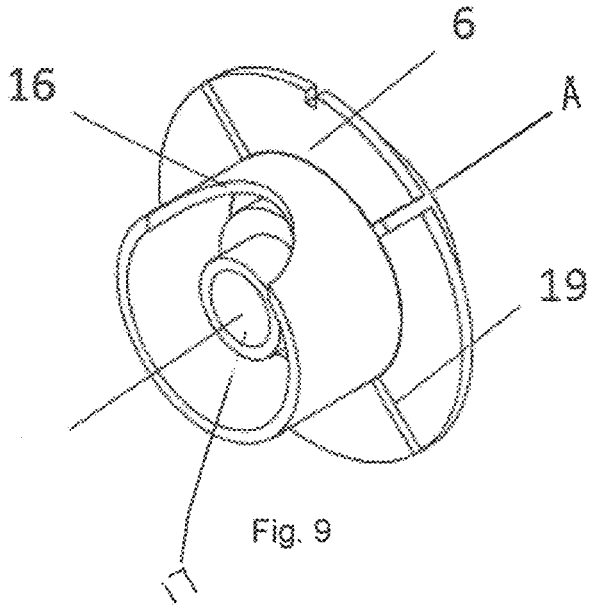
FIG. 9 exemplarily illustrates an isometric view of the radial MBS baffle identifying key features, in accordance with various embodiments of the present disclosure.
Figure 10:
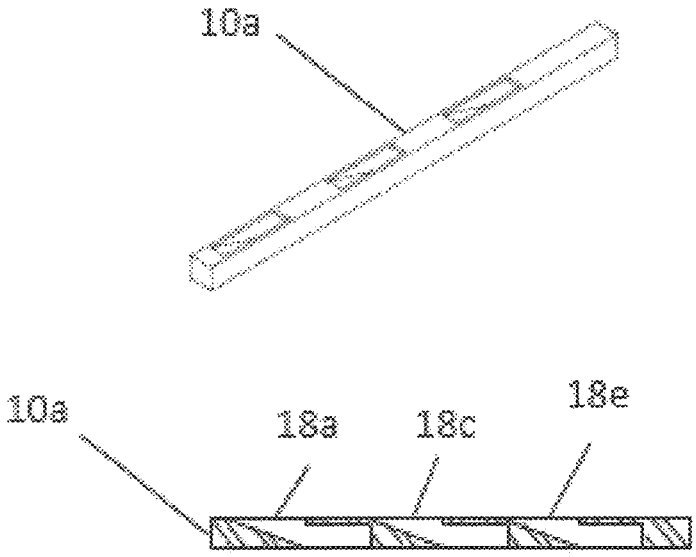
FIG. 10 exemplarily illustrates a Radial MBS exhaust diverter housing in accordance with various embodiments of the present disclosure.
Figure 11:
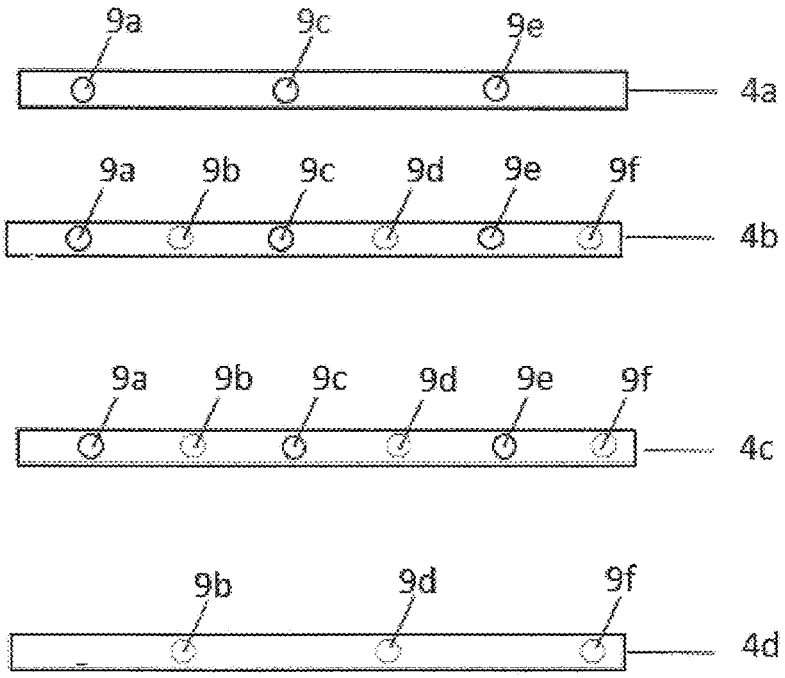
FIG. 11 exemplarily illustrates a Radial MBS divider bar, in accordance with various embodiments of the present disclosure.
Figure 12:
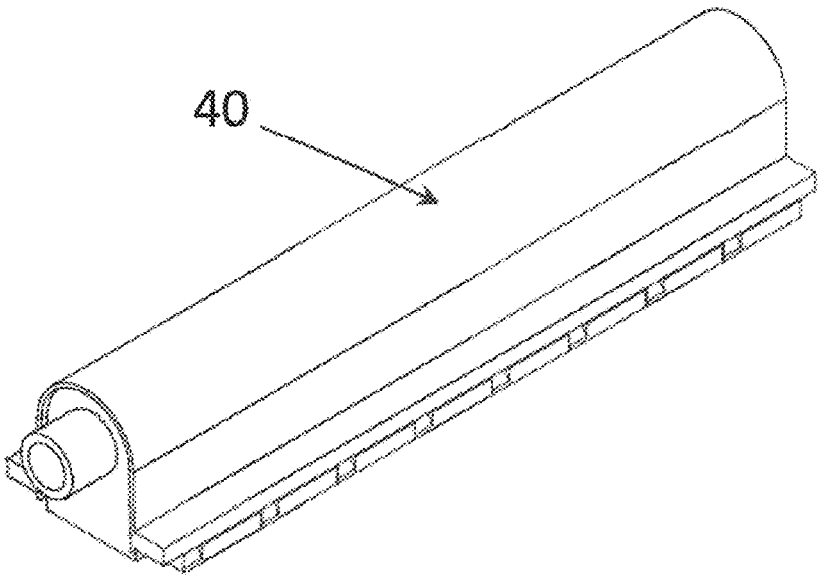
FIG. 12 exemplarily illustrates an isometric view of the lateral MBS, in accordance with various embodiments of the present disclosure.
Figure 13:
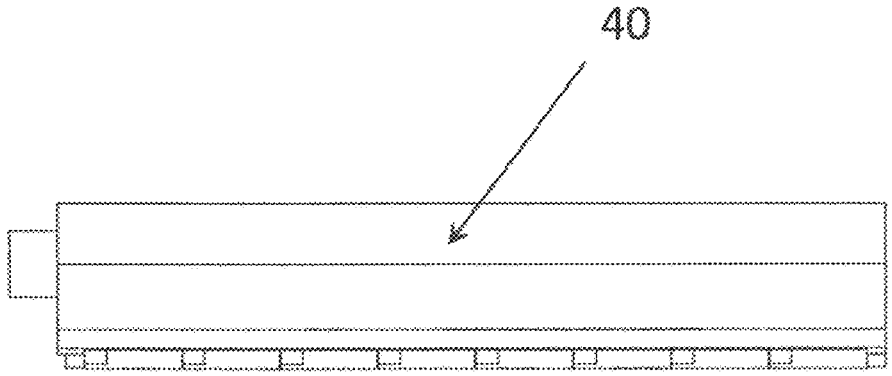
FIG. 13 exemplarily illustrates a side view of the lateral MBS, in accordance with various embodiments of the present disclosure.
Figure 14:
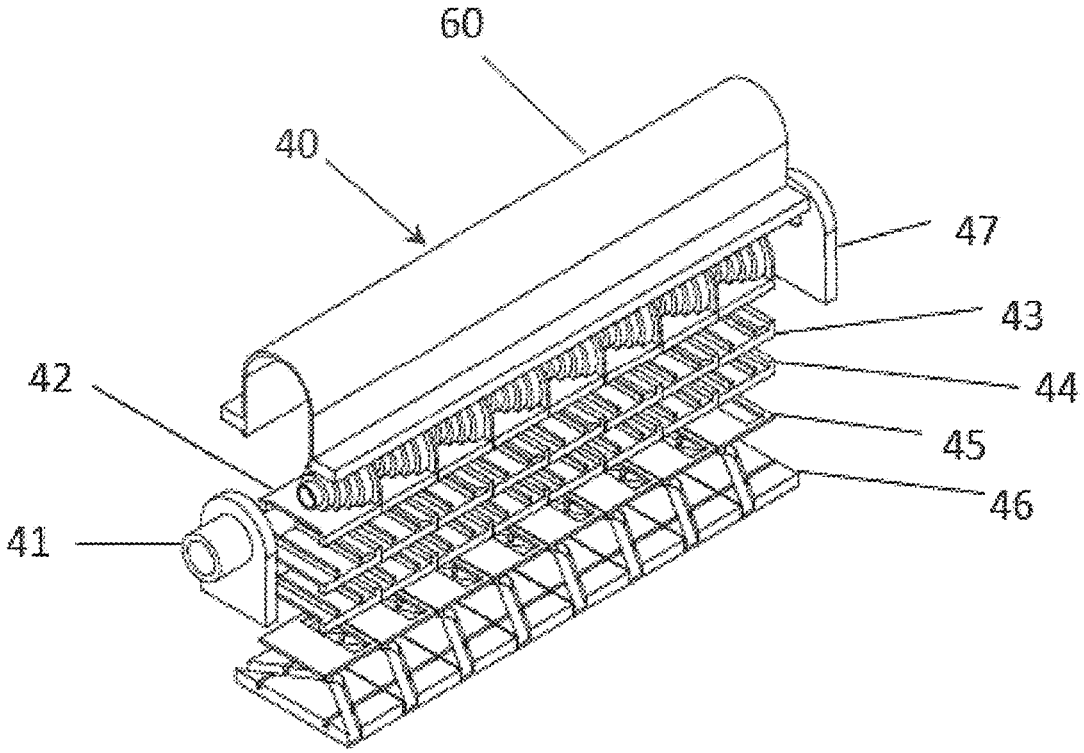
FIG. 14 exemplarily illustrates an exploded assembly view of the lateral MBS identifying key internal components in accordance with various embodiments of the present disclosure.

FIG. 9 exemplarily illustrates an isometric view of one of a plurality of a baffles 6 that are structured and operable to absorb pressure, velocity and/or temperature of the muzzle exhaust gas as the muzzle exhaust gas enters each respective axial stage 14. Each baffle 6 being disposed within a respective one of the axial stages 14 (e.g., baffle 6*a* is disposed within axial stage 14*a*, baffle 6*b* is disposed within axial stage 14*b*, etc.). FIG. 10 is an exemplary cross-sectional view of one of the exhaust diverter housings 10 (e.g., exhaust diverter housing 10*a*) and FIG. 11 exemplarily illustrates four divider bars 4 which includes the orifice/ports 9.

As the projectile exits the first axial chamber 14*a* and enters the second axial stage 14*b*, there is still significant residual pressure from the propellant gas in the first axial stage 14*a*, although not as great as what the pressure was while the projectile was within the first axial stage 14*a*, as some of the propellant gas has been exhausted to the atmosphere in the first axial stage 14*a*, via passage through the secondary expansion chambers 12 and the exhaust orifice 5*a*. The propellant gas flows through from the primary chamber 11*a* of the first axial stage 14*a* into the primary chamber 11*b* of the second axial stage 14*b*. Once projectile fully enters the second axial stage (base of projectile moves axially past the bore opening 17*b*) the propellant gas travels through the bore opening 17*b* allowing gas to expand from the first axial stage 14*a* to the second axial stage 14*b*. There is no other way for the propellant gas to travel from one axial stage to the next without travelling through the bore opening 17. As similarly described above with regard to the gas flow through the first axial stage 14*a*, via the expansion port 16*b* of the second axial stage 14*b* the gas flows from the primary chamber 11*b* of the second stage 14*b* into the first secondary expansion chamber 12*a* of the second stage 14*b*, then into the second secondary expansion chamber 12*b* via an orifice/port 9*b* in the fourth diverter bar 4*d*, then into the third secondary expansion chamber 12*c* via an orifice/port 9*b* in the third diverter bar 4*c*, then into the fourth secondary expansion chamber 12*d* via an orifice/port 9*b* in the second diverter bar 4*b* and finally exhausted to the ambient environment via the exhaust port 5*b* in the outer housing 3. The diverter bars 4*a*, 4*b*, 4*c* and 4*d* extend longitudinally within the outer housing 3 and also extend through each of the plurality of axial stages 14, thereby subdividing each axial stage 14 into the plurality of secondary expansion chambers 12 in each of the plurality of the axial stages 14, that is each diverter bar 4 extends through and subdivides all the axial stages. The first diverter 4*a* bar for the fourth secondary expansion chamber 12*d* of the second axial stage 14*b* does not have an orifice which forces the propellant gas to exhaust via exhaust port 5*b* to into the ambient external environment. Note that the for the second axial stage the direction of the propellant gas expansion is reversed. As a result, the second stage fourth diverter bar 4*g* has the first orifice port 9*b* connecting the first secondary expansion chamber 12*a* to the second secondary expansion chamber 12*b*. Likewise, the second stage third diverter bar 4*c* has the second orifice port 9*b* connecting the second secondary expansion chamber 12*b* to the third secondary expansion chamber 12*c*. Likewise, the second stage second diverter bar 4*b* has the third orifice port 9*b* connecting the third secondary expansion chamber 12*d* to the fourth secondary expansion chamber 12*d*. The first diverter bar for the second stage does not have an orifice forcing the propellant gas to exhaust out of the exhaust port 5*b*. The direction of the gas is changed from a radial direction rearward by the exhaust housing port 18*b* in exhaust diverter housing 10*b*.

The direction of propellant gas expansion is reversed or each subsequent axial stage 14. For the presently described exemplary embodiment, the propellant gas travels in a counterclockwise direction for first 14*a*, third 14*c* and fifth 14*e* stage and in a clockwise direction for the second 14*b*, fourth 14*d* and sixth 14*f* axial stage. By doing so the exhaust pressure is more closely balanced between the two exhaust diverter housings 10*a* and 10*b* which are on opposite sides of each other which more effectively balances the lateral force created by the exhausting propellant gas.

How the propellent gas expands in the second axial stage is similar to how it expanded in the first axial stage. The size of the orifice/ports 9 in the diverter bars 4 (e.g., diverter bars 4*a*, 4*b*, 4*c* and 4*d*) and the size of the exhaust ports 5 in the outer housing 3 are sized based on the propellant gas pressure for that particular stage. For instance, the pressure in the first axial stage 14*a* will be higher than the pressure in the second axial stage 14*b*. This is a result of two phenomena: the volume for the propellant gas to expand into has increase and some of the propellant gas has been exhausted in the first axial stage 14*a*. In addition, the orifice size for each secondary expansion chamber 12 can be structured, sized and shape as needed based on the propellant gas pressure for that particular axial stage and secondary expansion chamber. While the projectile is within the second axial stage 14*b*. This continues for the subsequent axial stages 14. As the bullet enters each subsequent axial stage 14, the propellant gas pressure is reduced as the gas has been partially exhausted in all the previous axial stages 14 and exhausted through the previous exhaust ports 5. Eventually the projectile passes through all the axial stages 14 and exits the MBS by passing through the bore 2*a* in the endcap 2. Each axial stage 14 has the orifice/ports 9 and exhaust ports 5 structured, sized and shaped based on the propellant gas and pressure that will be present while the projectile is within that axial stage.

For example, when a projectile of a high-powered sniper rile exits the muzzle, the pressure in the blast chamber 13 may be 13,000 psi. When the projectile enters the first axial stage the pressure may be reduced to 12,000 psi due to the increased volume. The orifice sizes in the first axial stage 14*a* would be designed for the 12,000 psi primary chamber pressure. Once the projectile enters the second axial stage, the pressure may have dropped to 10,000 psi as the volume has increased and some of the propellant gas exhausted out of the exhaust orifice 5*a* in the first axial stage 14*a*. The orifice sized for the second axial stage are designed for the 10,000 psi pressure. Once the projectile has entered the third axial stage, the pressure may have dropped to 8,000 psi as the volume has increased and some of the propellant gas exhausted out of the exhaust orifice 5*a* and 5*b* in the first two axial stage 14*a* and 14*b*. The orifice sized for the second axial stage are designed for the 8,000 psi pressure. This continues in a similar fashion for all subsequent axial stage. For instance, the pressure may be 6,000 psi for the fourth stage 14*d*, 4,000 psi for the fifth stage 14*e* and 2,000 psi for the sixth stage. Once the projectile exits through the bore opening 2*a*, the propellant pressure may be down to only 1,000 psi.

An additional design consideration in sizing of the orifice/ports 9 is the balance of recoil reduction vs. noise suppression. If a higher level of recoil reduction is required, the balance would be skewed towards exhausting more propellant gas at each axial stage 14. If greater noise suppression was desired, less propellant gas would be exhausted, especially in the earlier axial stages 14 where the pressure would be higher.

In various embodiments, the MBS 1 of the present embodiments comprises the outer housing 3 having a muzzle mount 8 and an end cap 2. The muzzle mount 8 is connected to or integrally form with an outer tube or housing 3 of MBS 1 and is structured and operable to mount the MBS 1 to the barrel of the firearm (e.g., barrel 200). The first baffle 6 next to the muzzle mount 8 is referred to herein as the blast baffle 7. The blast baffle 6*b* is substantially stronger (e.g., 1.5 to 5.0 times stronger) and erosion resistant than the subsequent baffles 6 as it is subjected to much higher propellant gas pressure, velocity and temperature. Adjacent to the blast baffle 7 and disposed within the first axial stage 14*a* is a first axial stage baffle 6*a*. And similarly, second through sixth baffles 6*b*, 6*c*, 6*d*, 6*e* and 6*f* are disposed within the second through the sixth axial stages 14*b*, 14*c*, 14*d*, 14*e* and 14*f*. In various embodiments, the MBS 1 comprises four diverter bars (4*a*, 4*b*, 4*c* and 4*d*) that hold the baffles 6 in radial alignment. In addition, each diverter bar 4 includes the orifice/ports 9 that allow the gas to flow from one secondary expansion chamber 12 into the next secondary expansion chamber 12 for each respective axial stage 14. As described above, the outer housing 3 includes exhaust orifices 5*a*, 5*b*, 5*c*, 5*d*, 5*e* and 5*f*, which are connected to the angled exhaust ports (18*a*, 18*b*, 18*c*, 18*d*, 18*e*, 18*f*) disposed in the exhaust diverter housings 10 (e.g., 10*a* and 10*b*). In various embodiments, the MBS 1 is structured and operable to connect to a barrel (e.g., barrel 200 in FIG. 1) of a gun via the muzzle mount 8.

The blast chamber 13 is disposed within muzzle mount 8 and defined by the muzzle mount 8 one of the first axial stage 14*a*. As described above, when a projectile is fired and the base of the projectile is fully entered into the MBS 1, the projectile first enters the blast chamber 13. The propellant gas (i.e., burning 'gunpowder') discharged from the barrel of a gun (e.g., barrel 200 shown in FIG. 1) into the blast chamber 13 expands at a very high velocity, pressure and temperature. The blast chamber 13 size and volume is defined by blast baffle 6B and the muzzle mount 8. The blast baffle 7 and muzzle mount 8 are designed to withstand the high temperature, pressure and velocity of propellant gas at the end of the firearm barrel (e.g., barrel 200 shown in FIG. 1). Typical pressures can exceed 13,000 psi at the muzzle as the bullet exist the barrel. The specific pressure is a function of the cartridge, projectile weight, type of propellant and barrel length and varies significantly from one gun to another. The projectile passes through the blast baffle 6B and once the projectile base is fully past the blast baffle 6B the projectile is in the first axial stage 14*a*. The propellant gas expands from the volume within the gun barrel 200 and blast chamber 13 to first fill the primary chamber 11*a* of the first axial stage 14*a*. The gas then begins to expand into the first secondary expansion chamber 12*a* of the first axial stage 14*a* by travelling through the expansion port 16, in baffle 6*a*. As described above, the gas continues to expand from the first secondary expansion chamber 12*a* of the first stage 14*a*, to the second, third and fourth secondary expansion chambers 12*b*, 12*c* and 12*d* of the first stage 14 by travelling through the orifice/ports 9 that is in the first, second, and third diverter bar 4*a*, 4*b* and 4*c*.

Also as described above, furthermore, the orifice/ports 9 (e.g., exhaust ports 9*a*, 9*b*, 9*c*, 9*d*, 9*e*, 9*f*) can be structured, sized and shaped to control the rate, volume, pressure and temperature of expansion of propellant gas from one secondary expansion chamber 14 to the next within each respective axial stage 14. Each respective orifice/port 9 can be structured, sized and shaped differently if desired and the structure, size and shape are not constrained by the projectile diameter as it is in a traditional suppressor. In an exemplary embodiment of the MBS 1 there are six axial stages with five secondary expansion chambers within each axial stage. Thus, there are a total of thirty orifice/ports 9. Each orifice/port 9 can be structured, sized and shaped for the particular secondary expansion chamber 12 and stage 14. Each orifice/port 9, and similarly each exhaust port 5 can be structured, sized and shaped to balance noise suppression, recoil reduction and dust signature to satisfy and desired requirements. The number of axial stages 14 and secondary expansion chambers 12 can be increased or decreased as dictated by design requirements. The exemplary embodiment illustrated in FIGS. 4, 5 and 6 has six axial stages (6*a*, 6*b*, 6*c*, 6*d*, 6*e* and 6*f*). In addition, each axial stage 14 in FIGS. 4, 5 and 6 is exemplarily illustrated to comprise a primary expansion chamber 11 and four secondary expansion chambers (12*a*, 12*b*, 12*c* and 12*d*).

Figure 15:
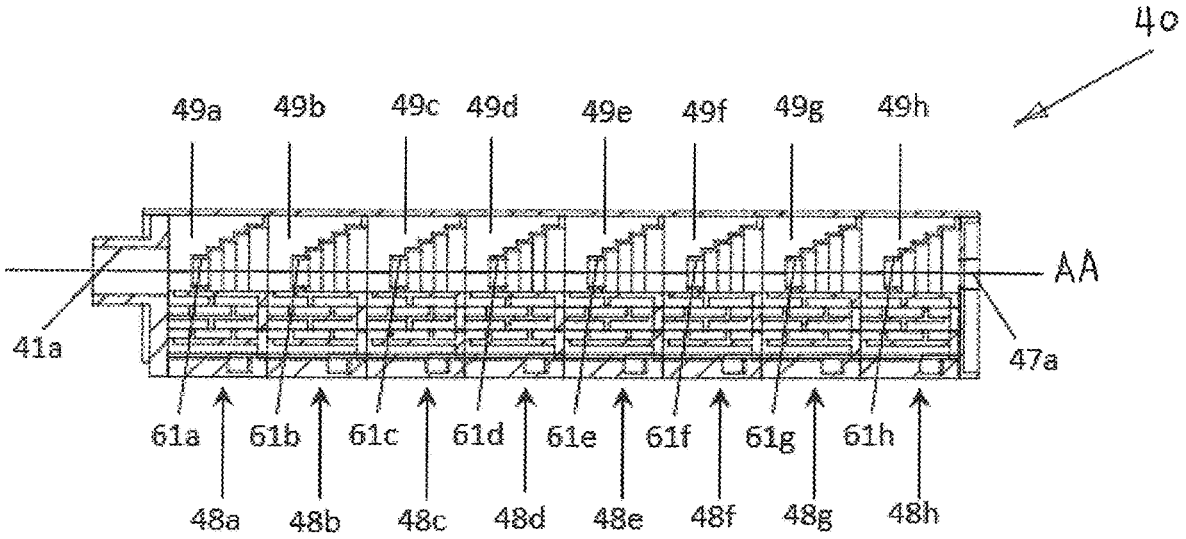
FIG. 15 exemplarily illustrates a cross sectional side view of the lateral muzzle braked suppressor, identifying the axial stages and primary chambers in accordance with various embodiments of the present disclosure.
Figure 16:
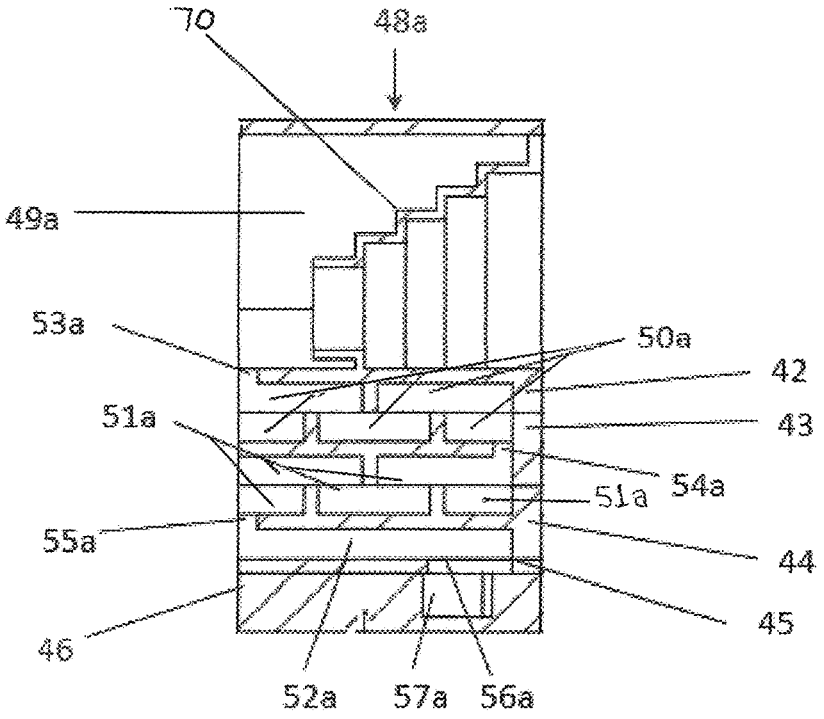
FIG. 16 exemplarily illustrates a side section view of the first axial stage to provide expansion chamber and orifice identification for the lateral MBS, in accordance with various embodiments of the present disclosure.

Referring now to FIGS. 11 through 17, in accordance with various other embodiments, the present disclosure provides an MBS configured in a lateral configuration, referred to herein as lateral MBS 40. Similar to the radial MBS 1 described above, the MBS 40 is likewise structured and operable to reduce recoil while at the same time reducing the muzzle blast and noise signature. The lateral MBS 40 is exemplarily illustrated in FIG. 12-17 and in an exploded view of the internal components in FIG. 14. FIG. 15 exemplarily illustrate a cross sectional view of the assembled lateral MBS 40. The lateral MBS 40 attaches to the barrel of a gun via a muzzle mount 41. The muzzle mount 41 is connected to or integrally form with an outer tube or housing 60 of MBS 40 and is structured and operable to mount the MBS 40 to the barrel of the firearm (e.g., barrel 200). This particular exemplary embodiment of the MBS does not have a blast chamber as the orifices, openings and ports are designed to accommodate the higher pressure, velocity and temperature of the propellant gas as it exits the barrel of the gun.

As exemplarily illustrated in FIGS. 14-17, in various embodiments the radial MBS 40 comprises a plurality of fluidly connected axial stages 48*a*, 48*b*, 48*c*, 48*d*, 48*e*, 48*f*, 48*g* and 48*h*, a plurality of fluidly connected primary expansion chambers 49*a*, 49*b*, 49*c*, 49*d*, 49*e*, 49*f*, 49*h* and 49*g*, and each axial stage comprises a plurality of fluidly connected secondary expansion chambers 50, 51 and 52. The axial stages 48 are disposed within the outer housing 60 and axially connected head-to-toe with each other along, and coaxially centered on, a center axis AA of the MBS 40. The propellant gas expands into the primary chamber 49*a* of the first axial stage 48*a* which is defined by the muzzle mount and the tube 58. The axial stages 48 are identified in FIG. 14. There are multiple axial stages 48, for example an exemplary embodiment is illustrated with eight axial stages: 48*a*, 48*b*, 48*c*, 48*d*, 48*e*, 48*f*, 48*g* and 48*h*. Lateral secondary expansion chambers 50*a*, 51*a* and 52*a* for the first axial stage 48 are identified in FIG. 15. There can be multiple secondary expansion chambers in each axial stage 48, for example FIG. 15 illustrates three secondary expansion chambers 50*a*, 51*a* and 52*a* for axial stage 48*a*. Each secondary expansion chamber 50, 51 and 52 is separated by and defined by the lateral plates (e.g., lateral plates 42, 42 and 44) and the outer housing. For instance, for the first axial stage 48*a* the primary expansion chamber 49*a* is defined by the baffle-first lateral plate 42, the second lateral plate 43 and the outer housing 3. The baffle-first lateral plate 42 can integrate the baffle with a first lateral plate as is illustrated in this embodiment or the baffle and lateral plate components can be two separate components, but still achieve the same result. The side wall for all of the secondary expansion chambers in made up of the outer tube or housing 60. The second secondary expansion chamber 51 is defined by the second lateral plate 43 and the third lateral plate 44. The third secondary expansion chamber 52 is defined by the third lateral plate 44 and the exhaust diverter separator plate 45. The exhaust port 57 is defined by the exhaust diverter separator plate 45 and the exhaust diverter plate 46. In various embodiments, the MBS 40 is structured and operable to connect to the barrel of a gun through a muzzle mount 41.

Figure 17:
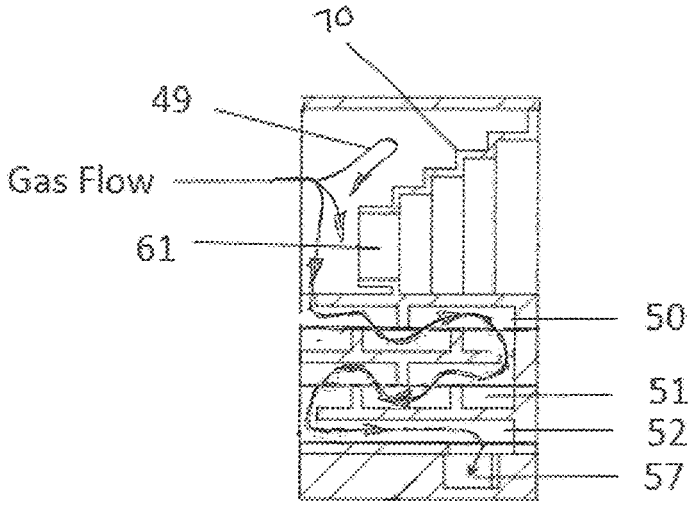
FIG. 17 exemplarily illustrates a perpendicular axial section view of the first axial stage to illustrate the propellant gas flow through the expansion stages identified in FIG. 16 for the Lateral MBS, in accordance with various embodiments of the present disclosure.
Figure 18:
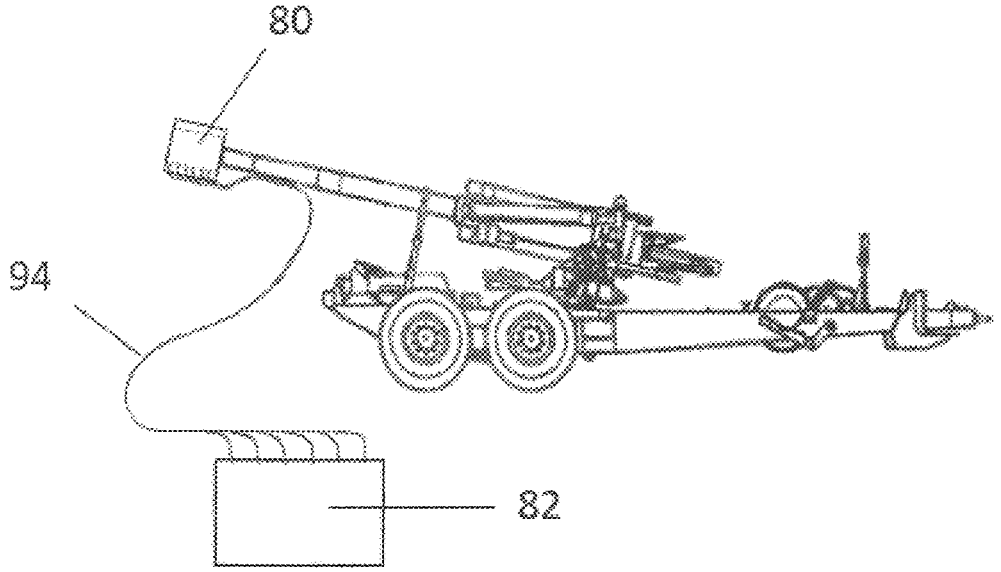
FIG. 18 exemplarily illustrates a large gun (a 155 mm howitzer) with an MBS that has external expansion chambers.

When a projectile is fired, and the base of the projectile fully enters into the muzzle mount 41 the propellant gas (expands i.e., burning 'gunpowder') into the primary chamber 49*a* of the first axial stage 48*a*. The propellant gas is at a very high velocity, temperature and pressure that depends on multiple parameters such as barrel length, the specific propellant used, projectile weight, cartridge and more. The muzzle pressure can range from less than 5,000 psi to more than 20,000 psi (or even more in the case of rifles with very short barrels). Typical high-power rifles range from 10,000 psi to 15,000 psi. The propellant velocity likewise will vary significantly from 1,000 feet per second to 9,000 feet per second. As the propellant gas expands into the primary chamber, the volume of the gas increases and the pressure, velocity and temperature is reduced. This exemplary embodiment of the MBS 40 does not have a traditional blast chamber and the orifice ports/openings are large such that the propellant gas quickly flows to fill all of the secondary expansion chambers within the first stage thus functioning as a blast chamber. When the projectile enters the first axial stage, the propellant gas expands from the primary chambers 49*a* to the first lateral secondary expansion chamber 50*a* by travelling through the through the orifice port/opening 53*a* in the baffle-first lateral plate 42. The flow of the expanding propellant gas is illustrated in FIG. 17, wherein a cross-sectional view of the first axial stage 48*a* is exemplarily illustrated showing that in various embodiments the secondary expansion chambers 50, 51 and 52 are laterally fluidly connected via the orifice/ports 53, 54 and 55 such that the exhaust gas flows through the expansion chambers 50, 51 and 52 in a back-and-forth or serpentine or lateral flow path beneath or radially outward from the respective primary chamber 49 and the respective baffle 70. Each baffle 70 is structured and operable to absorb pressure, velocity and/or temperature of the muzzle exhaust gas as the muzzle exhaust gas enters the respective axial stage 48.

The gas continues to expand from the first secondary expansion chamber 50*a*, to the second secondary expansion chamber 51*a* by travelling through the orifice port/opening 54*a* that is in the second lateral plate 43. Once again, the propellant gas travels from the second secondary expansion chamber 51*a* to the third secondary expansion chamber 52*a* by passing through the orifice port/opening 55*a* which is in the third lateral plate 44. Finally, the propellant gas expands from the third secondary expansion chamber 52*a* to the exhaust port 57*a* by passing through the orifice port/opening 56*a* in the exhaust diverter separator plate 45. The propellant exhaust gas exits to the atmosphere via the exhaust port 57*a*.

In similar fashion, the as the projectile base fully enters the second axial stage, the propellant gas continues to expand from the primary chamber 49*a* of the first axial stage 48*a* into the primary chamber 49*b* of the second axial stage 48*b*. The propellent gas temperature, velocity and pressure is reduced as a consequence of the increased volume as well as the fact that some of the gas has been exhausted through the first stage 48*a*. The propellant gas volume now fills the barrel, first axial stage 48*a* and is beginning to fill then second axial stage 48*b*. The propellant gas expands from the primary chamber 49*b* of the second axial stage to the first secondary expansion chamber 50*b* within the second stage 48*b*. The rest of the cycle repeats similar to the way described for the first axial stage 48*a*. Once the projectile exits the second stage 48*b* and enters the third stage 48*c* and once again the cycle repeats. This continues to occur for all of the subsequent axial stages (e.g., fourth, fifth, sixth, seventh and eighth axial stages 48*d*, 48*e*, 48*f*, 48*g* and 48*h*). Each subsequent axial stage 48 is subject to less propellant gas temperature, velocity and pressure as the volume within the MBS 40 that is filled with is increased at each stage 48 and some of the propellant gas is exhausted at each axial stage 48.

As the projectile travels down the bore by passing through the bore opening 61 for each axial stage 48 in the lateral MBS 40, some of the propellant is being cumulatively exhausted through all of the previous axial stages that the projectile has passed. For instance, once the projectile has fully entered the first axial stage 48*a*, the propellant gas is being exhausted out of the first stage exhaust port 57*a* only. Once the projectile has fully entered the second axial stage 48*b*, then the propellant gas now has twice the volume in the MBS 40 as it fills to expand the full volume of the first axial stage 48*a* and the second axial stage 48*b*. In addition, the propellant gas is being exhausted by both axial stages as well through exhaust housing ports 57*a* and 57*b*. When the projectile fully enters the last axial stage 48 (e.g., the eighth axial stage 48*h*), the propellant gas is being exhausted by the first, second, third, fourth, fifth, sixth, seventh and eighth axial stage exhaust ports 57*a*, 57*b*, 57*c*, 57*d*, 57*e*, 57*f*, 57*g* and 57*h*. Initially some of the propellant gas is exhausted by the first axial stage 48*a* via exhaust housing port 57*a*, then by the first and second axial stage 48*a* and 48*b* via first that second exhaust housing ports 57*a* and 57*b*, and so on until the propellant gas is cumulatively being exhausted by all of the axial stages 48 including the eighth axial stage 48*h* via exhaust housing port 57*h*.

The projectile ultimately exits the lateral MBS 40 via the end cap 47. Any residual gas pressure then would exit via the bore hole 47*a* in the end cap 47 as well all of the exhaust ports 57 for all eight axial stages 48. The volume of gas exhausted would depend on the gas pressure as well as the volume of the secondary expansion chambers 49, 50, 51 and 52, the orifice port 53, 54, 55 and 56 size, and the exhaust port 57 size. The size of the orifice port/opening 53, 54, 55 and 56 can be different from one secondary expansion chamber 49, 50, 51 and 52 to the next as well as from one axial stage 48*a*, 48*b*, 48*c*, 48*d*, 48*e*, 48*f*, 48*g* and 48*h* to the next. All of these can be structured, sized and shaped based the specific gas conditions encountered and needing to be addressed. Furthermore, the orifice port/openings 53, 54, 55 and 56 are not constrained by the projectile size as is the case between axial stages. The orifice port/opening 53, 54, 55 and 56 and exhaust port 57 size can be determined by analysis and will vary based on balancing noise suppression, recoil reduction and dust signature requirements. In various exemplary embodiments, eight axial stages with three secondary expansion chambers 50, 51 and 52 per stage were shown.

The number of axial stages and secondary expansion chambers can be increased or decreased as dictated by design requirements.

Figure 19:
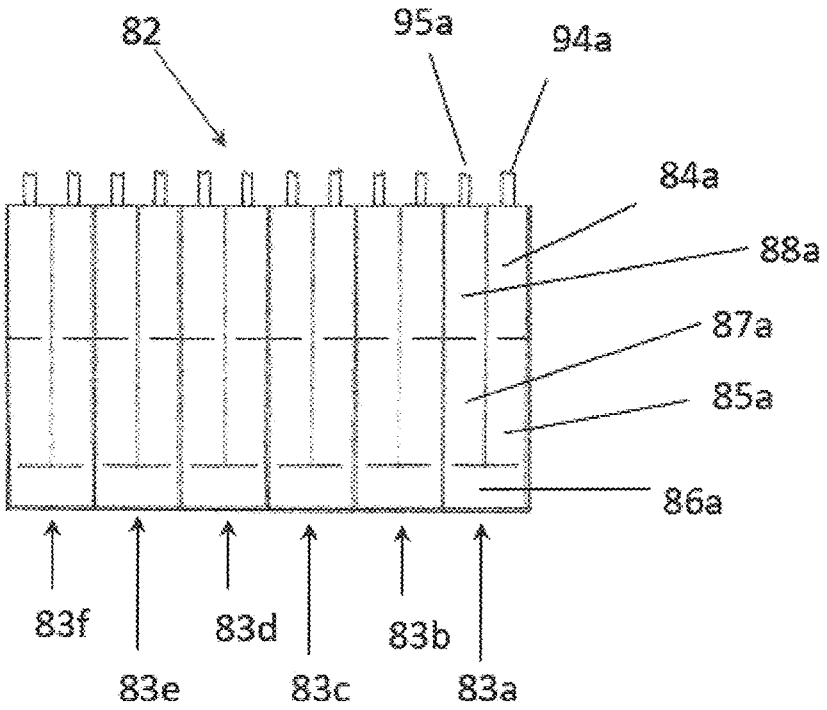
FIG. 19 exemplarily illustrates an external expansion chamber with the corresponding axial stages and expansion chambers identified.
Figure 20:
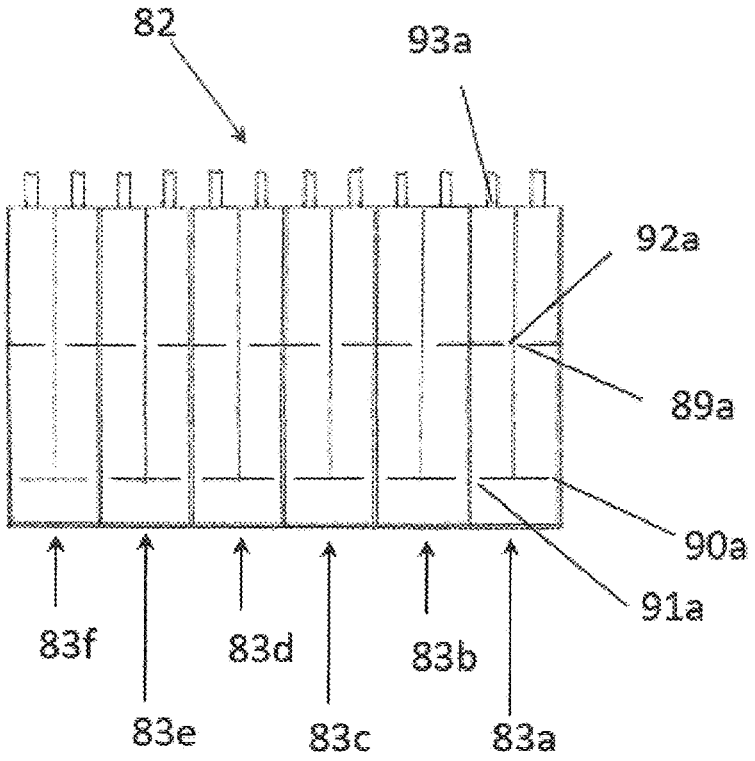
FIG. 20 exemplarily illustrates an external expansion chamber with the corresponding orifice ports/openings for each expansion chamber identified.
Figure 21:
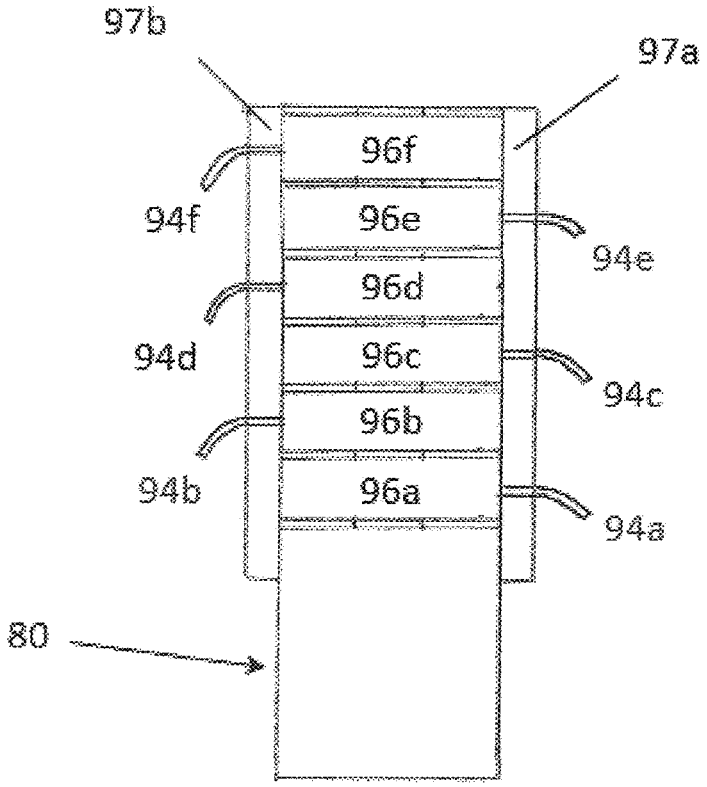
FIG. 21 exemplarily illustrates the top view main body of the MBS with the axial stages and external pipes identified.

Referring now to FIGS. 18-21, in various other exemplary embodiments a MBS 80 can be configured such that some of the expansion chambers in some of the axial stages are detached from the main body 80 and connected to an external expansion tank 82 by external pipes 94. The external propellant gas pipes 94 connect to the exhaust diverter 97*a* and 97*b* of the main body 80 of the MBS 80 at individual axial stages. The initial portion of the external pipe(s) 94 is rigid as it recoils with the gun barrel. Each external pipe 94 has a flexible portion which connects to the rigid section of the pipe 94. The flexible section of each pipe 93 connects to external expansion tank 82. The external expansion tank 82 is not mounted on the gun and is placed a distant to the gun. The distance is constrained by the length of the pipes 94 that joins the main body of the MBS 80 to the external expansion tank 82. The MBS 80 can have only a primary expansion chamber before the propellent gas exits the diverters 97*a* and 97*b*, or can have multiple expansion chambers before the propellant gas is exhausted out of the exhaust diverter housings. In addition, the main body can be configured as a radial MBS 1 or as a lateral MBS 40. There are multiple external propellant gas pipes 94*a*, 94*b*, 94*c*, 94*d*, 94*e* and 94*f*, typically one for each axial stage of the MBS 80. The illustrated exemplary embodiment has six axial stages 96*a*, 96*b*, 96*c*, 96*d*, 96*e* and 96*f*. The gas pipes 93 connect to independent expansion chambers within the external expansion tank 82. The external expansion tank 82 can have significantly more volume than the main body of MBS 80 that is attached to the barrel of the weapon. In addition, there can be multiple expansion chambers for each axial stage. FIG. 19 illustrates an external expansion tank with six axial stages 83*a*, 83*b*, 83*c*, 83*d*, 83*e* and 83*f*. These correspond to the axial stages 96*a*, 96*b*, 96*c*, 96*d*, 96*e* and 96*f* in the main body of the MBS 80. Each expansion chamber will be connected to an exterior tube 94*a*, 94*b*, 94*c*, 94*d*, 94*e* and 94*f*. For instance, the first axial stage 96*a* of the MBS 80 is connected to external pipe 94*a* through the exhaust diverter 97*a*. The flexible portion of external pipe 94*a* is connected to the first expansion chamber 84*a* within the axial stage 83*a* of the external expansion tank 82. Each axial stage 83 can have multiple expansion chambers 84, 85, 86, 87 and 88. For instance, the first axial stage 83*a* has expansion chambers 84*a*, 85*a*, 86*a*, 87*a* and 88*a*. The flow of the propellant gas is throttled by the opening ports/orifices 89*a*, 90*a*, 92*a* and 93*a*. The propellant gas is exhausted through the exhaust port 93*a*.

When a projectile is fired and the base of the projectile fully enters into first axial stage 96*a*, the propellant gas expands from the primary chamber and fills subsequent expansion chambers within the main body of MBS 80 until the propellant gas exhausts out of the exhaust port in the MBS 80. The gas flows from the exhaust port through the exterior tube 94*a* until it expands into the first external expansion chamber 84*a* for the first axial stage 83*a* of the external expansion tank 82. The propellant gas continues to expand from the first expansion chamber 84*a* to the second expansion chamber 85*a* by flowing through the orifice port/opening 89*a*. The propellant gas continues to expand from the second expansion chamber 85*a* to the third expansion chamber 86*a* by flowing through the orifice/port 90*a*. Once again, the propellant gas expands from the third expansion chamber 86*a* to the fourth expansion chamber 87*a* by flowing through the orifice/port 91*a*. Once again, the propellant gas expands from the fourth expansion chamber 87*a* to the fifth expansion chamber 88*a* by flowing through the orifice/port 92*a*. Finally, the exhaust gas is exhausted to the atmosphere by flowing out of the exhaust port 93*a*.

Each time that the propellant gas flows from one expansion chamber to the next the volume increases and propellant gas temperature and pressure decreases. Once the propellant gas exhausts through the exhaust pipe 95*a*, the expansion volume has significantly increased, and temperature and pressure decreased. This results in a reduction of the blast, noise and percussion so the remaining amount of propellant gas left in the barrel and MBS has been decreased.

As the projectile travels down the bore of the MBS 80 and the projectile base fully enters the second axial stage 83*b*, the propellant gas flows into external pipe 94*b* and continues to flow to the main external expansion chamber 83*b* for the second axial stage 83*b* of the main body of the MBS 80. The main expansion chamber 83*b* of the external expansion tank 82 has multiple expansion chambers and the propellant gas continues to expand as it enters each expansion chamber. In addition, the pressure and temperature of the propellant gas is less as now the volume is distributed over two axial stages in the MBS 80, two external tubes and two main chambers within the external expansion tank 82. In addition, some of the propellant gas has been exhausted by the first main expansion chamber 83*a* of the external expansion tank 82.

As the projectile continues down the bore of the MBS and the base enters each subsequent axial stage, the propellant gas continues to expand to the third axial stage 83*c*, external pipe 94*c* and main expansion chamber of the external expansion tank 82. As it does this the volume is increased with each subsequent axial stage. In addition, some of the propellant gas has been exhausted at each previous main chamber within the external expansion tank.

The orifice/port 89, 90, 91, 92 and 93 for each stage 83 of the external expansion tank 82 and each main expansion chamber volume can structured, sized and shape based on the desired volume temperature and pressure control of the propellant gas that it receives.

An external expansion tank 82 can be utilized with any type of MBS as long as an external pipe 94 can be affixed to the exhaust diverter housing 97 of the main body of the MBS 80.

The external expansion tank 82 will have more applicability for large guns/artillery than small shoulder fired weapons. The primary objective is to decrease percussion to the gun crews. A secondary benefit is to reduce the muzzle blast which kicks up a significant amount of dust and debris.

Referring now to FIGS. 1 through 21, in accordance with the above described various embodiments, by the time that the projectile exits the respective MBS, the gas volume, temperature and pressure has been reduced for the complete time that the projectile has been inside of the respective MBS. Traditional suppressors can reduce the temperature and pressure of the propellant gas but cannot reduce the total mass of gas, rather all of the gas contained in the barrel and suppressor is exhausted when the bullet exits the suppressor. In addition to reducing the pressure as a result of the temperature drop, the MBS reduces volume and mass of the propellant gas of the propellant gas as a direct result of the gas being exhausted at each axial stage. In addition, the MBS cools the propellant gas more effectively than a traditional suppressor. A traditional suppressor cools the propellant gas by expansion to subsequent axial stages. Each axial stage causes turbulence by various methods, and the gas sheds its heat to the suppressor body.

This is effective, but in the process of cooling the gas, the suppressor itself absorbs heat. This is particularly true in fully automatic weapons. With subsequent shots, the suppressor is less able to absorb the heat, and thus less able to cool the propellant gas. This not only results in the suppressor overheating but being less effective at suppressing the sound with each subsequent shot. In sustained fully automatic fire the suppressor can reach temperatures in excess of 2000 F permanently damaging the suppressor in the process. The MBS exhausts the propellant gas at each axial stage via the exhaust port. In so doing, the MBS is actively cooled by the Joule-Thomson effect. This cooling is repeated for each axial stage and throughout the duration that the bullet is within the MBS.

While the pressure at each exhaust port is less than that of a traditional muzzle brake, the duration is longer, and the overall reduction in recoil impulse is the similar. In addition, the exhaust can be directed rearward at a greater angle increasing the effectiveness of reducing recoil while minimizing the blast and percussion as the propellant gas velocity and pressure will be less than with a traditional muzzle brake. The net result of this is that the recoil reduction can be even greater than that of a traditional exhaust brake. The MBS exhaust ports can be angled for increased recoil reduction, the port size can be varied to balance recoil reduction and noise reduction. The openings between each of the expansion chambers can individually be optimized for each axial segment. Particularly, he plurality of axial stages, the primary expansion chambers (in various embodiments), and the plurality of secondary expansion chamber in each axial stager are fluidly connected such that the muzzle exhaust gas flow will sequentially pass through each primary expansion chamber and each secondary expansion chamber whereby the muzzle exhaust gas expands and cools within each primary expansion chamber and within each secondary expansion chamber, such each primary expansion chamber and each secondary expansion chamber successively provides cumulative noise suppression, muzzle braking and muzzle exhaust gas cooling as the projectile passed through each subsequent axial stage and exits the MBS.

The description herein is merely exemplary in nature and, thus, variations that do not depart from the gist of that which is described are intended to be within the scope of the teachings. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the disclosure. Such variation ns and alternative combinations of elements and/or functions are not to be regarded as a departure from the spirit and scope of the teachings.

What is claimed is:

1. A muzzle braked suppressor (MBS), said muzzle braked suppressor comprising:

an outer housing;

a muzzle mount connected to the outer housing and structured and operable to mount MBS to the barrel of a firearm;

a plurality of fluidly connected axial stages axially connected along a center axis of the MBS, each axial stage comprising;

a primary expansion chamber that is fluidly connected to a plurality of fluidly connected secondary expansion chambers, wherein one of the secondary expansion chambers is fluidly connected with external environment via one of a plurality of exhaust orifices disposed in the outer housing, and a baffle, wherein the plurality of axial stages, the primary expansion chambers and the plurality of secondary expansion chambers in each axial stage are fluidly connected such that a muzzle exhaust gas flow will sequentially pass through each primary expansion chamber and each secondary expansion chamber whereby the muzzle exhaust gas expands and cools within each primary expansion chamber and within each secondary expansion chamber, such that each primary expansion chamber and each secondary expansion chamber successively provides cumulative noise suppression, muzzle braking and muzzle exhaust gas cooling, and wherein the baffle is structured and operable to absorb at least one of pressure, velocity and temperature of the muzzle exhaust gas as the muzzle exhaust gas enters the respective axial stage, and a pair of exhaust diverter housings disposed on an exterior of the outer housing, each exhaust diverter comprising a plurality of exhaust ports that each fluidly aligns with a corresponding one of the exhaust orifice in the outer housing.

2. The MBS of claim 1, wherein the exhaust diverter housings are angled to exhaust the gas from the MBS at an angle.

3. The MBS of claim 2 further comprising a blast chamber disposed within the muzzle mount and defined by the muzzle mount and one of the plurality of axial stages.

4. The MBS of claim 3 further comprising a blast baffle disposed within the blast chamber.

5. The MBS of claim 4 wherein the secondary expansion chambers are arcuately fluidly connected about the center axis.

6. The MBS of claim 5 further comprising a plurality of diverter bars that extend longitudinally within the outer housing and extend through each of the plurality of axial stages, thereby subdividing each of the plurality of axial stages into the plurality of secondary expansion chambers.

7. The MBS of claim 2, wherein the secondary expansion chambers are laterally fluidly connected radially outward from the respective primary expansion chamber.

8. The MBS of claim 7, wherein secondary expansion chambers are separated by and defined by a plurality of lateral plates.

9. A method for providing noise and recoil suppressing of a firearm utilizing a muzzle braked suppressor (MBS), wherein the muzzle braked suppressor comprises an outer housing; a muzzle mount connected to the outer housing and structured and operable to mount MBS to the barrel of a firearm; and a plurality of fluidly connected axial stages axially connected along a center axis of the MBS and a pair of exhaust diverter housings disposed on an exterior of the outer housing; wherein each axial stage comprises a primary expansion chamber that is fluidly connected to a plurality of fluidly connected secondary expansion chambers and a baffle, wherein one of the secondary expansion chambers is fluidly connected with external environment via one of a plurality of exhaust orifices disposed in the outer housing, said method comprising:

fluidly connecting the primary expansion chambers and the plurality of secondary expansion chamber in each axial stage;

sequentially passing a muzzle exhaust gas flow through each primary expansion chamber and each secondary expansion chamber of each axial stage;

allowing the muzzle exhaust gas to expand within each primary expansion chamber and within each secondary expansion chamber;

cooling the muzzle exhaust gas to expand within each primary expansion chamber and within each secondary expansion chamber such that each primary expansion chamber and each secondary expansion chamber successively provides cumulative noise suppression, muzzle braking and muzzle exhaust gas cooling;

absorbing at least one of pressure, velocity and temperature of the muzzle exhaust gas as the muzzle exhaust gas enters the respective axial stage via the baffle disposed with each axial stage; and diverting the muzzle exhaust gas to an eternal environment via a pair of exhaust diverter housings disposed on an exterior of the outer housing, each exhaust diverter housing comprising a plurality of exhaust ports that each fluidly aligns with a corresponding one of the exhaust orifice in the outer housing.

10. The method of claim 9 further comprising exhausting the muzzle exhaust gas to an eternal environment at a non-orthogonal angle relative to the center axis utilizing angled exhaust diverter ports.

11. The method of claim 10 further comprising initially expanding and cooling the muzzle exhaust gas via a blast chamber disposed within the muzzle mount and defined by the muzzle mount and one of the plurality of axial stages.

12. The method of claim 11 further comprising initially absorbing at least one of pressure, velocity and temperature utilizing a blast baffle disposed within the blast chamber.

13. The method of claim 12 wherein allowing the muzzle exhaust gas to expand and allowing the muzzle exhaust gas to cool comprises circulating the muzzle exhaust gas through the secondary expansion chambers in a circular path through about the center axis.

14. The method of claim 13 further comprising subdividing each of the plurality of axial stages into the plurality of secondary expansion chambers via a plurality of diverter bars that extend longitudinally within the outer housing and extend through each of the plurality of axial stages.

15. The method of claim 10, wherein allowing the muzzle exhaust gas to expand and allowing the muzzle exhaust gas to cool comprises circulating the muzzle exhaust gas through the secondary expansion chambers in a serpentine path radially outward from the respective primary chamber and of the respective axial stage.

16. The method of claim 15, further comprising subdividing each of the plurality of axial stages into the plurality of secondary expansion chambers via a plurality of lateral plates.

* * * * *